United States Patent [19]

Stephens

[11] 3,959,857

[45] June 1, 1976

[54] QUICK OPENING DEVICE FOR A SLIDE FASTENER

[75] Inventor: Milton L. Stephens, Meadville, Pa.

[73] Assignee: Textron, Inc., Providence, R.I.

[22] Filed: June 4, 1975

[21] Appl. No.: 583,699

[52] U.S. Cl. ..... 24/205 R; 135/1 R

[51] Int. Cl.[2] ..... A44B 19/00

[58] Field of Search ..... 24/205 R, 207 D; 135/15 CF

[56] References Cited

UNITED STATES PATENTS

| | | | |
|---|---|---|---|
| 2,296,358 | 9/1942 | Marinsky | 24/205 R |
| 3,122,808 | 3/1964 | Maschi | 24/205 R |

FOREIGN PATENTS OR APPLICATIONS

| | | | |
|---|---|---|---|
| 558,341 | 6/1958 | Canada | 24/205 R |

*Primary Examiner*—Bernard A. Gelak

[57] ABSTRACT

A slide fastener installation is disclosed as including conventional slide fastener components such as interlocking elements which are engaged and disengaged by a movable slider element permitting the slide fastener intallation to be actuated between closed and opened portions; an emergency opening device also causes disengagement of the interlocking elements permitting rapid opening of the slide fastener installation.

15 Claims, 6 Drawing Figures

QUICK OPENING DEVICE FOR A SLIDE FASTENER

BACKGROUND OF THE INVENTION

1. Field of the Invention

The present invention relates to a slide fastener installation and in particular to an emergency opening device for such installations so as to be particularly adaptable for use with tents, sleeping bags, etc.

2. Description of the Prior Art

The prior art, as exemplified by U.S. Pat. Nos. 3,122,808 and 3,331,107, is cognizant of the general concept of quick release mechanisms for slide fastener installations. However, such prior art devices are constructed for use with slide fasteners having individual interlocking elements, a significant portion of which are cut out so as to provide a gap which receives a release pin of the quick release mechanism. In addition, such mechanisms have further disadvantages in that they require separate assembly during engagement of the slide fastener elements, they require the locating and pulling of a separate release handle in emergencies, and they have a complex arrangement of separate components resulting in an extremely uneconomical device.

The use of tents in camping areas has increased substantially in recent years and it is conventional that campsites also include wood fireplaces as well as cooking stoves utilizing highly inflammable fuel, such as liquid petroleum. The hazard of fire is thus enlarged, particularly as the campsite normally includes a number of children. When fire occurs at the campsite, it is imperative that anyone in a tent remove himself to a safe area; however, the above prior art devices do not provide for an immediate and instantaneous exit from a tent which has its door flaps closed by a slide fastener.

SUMMARY OF THE INVENTION

The present invention is summarized in quick opening device for a slide fastener having two portions of material closed by engaged interlocking elements on adjacent edges of the material portions, which device includes operating means having a first part adapted for mounting on one of said material portions and a second part adapted to extend over the interlocking elements, and projecting means extending from the second part toward the engaged interlocking elements and being movable inbetween the engaged interlocking elements by a predetermined applied force to cause separation of the engaged interlocking elements.

An object of the present invention is to construct a slide fastener installation with an emergency opening arrangement.

Another object of the invention is to release a slide fastener installation to an open position in a simple manner as quickly as possible without requiring any pulling, releasing or unlocking.

It is a further object of this invention to provide a slide fastener installation with an emergency opener that can be reassembled quickly and without any mechanical assembly or manipulation.

Other objects and advantages of the present invention will become apparent from the following description of the preferred embodiments taken in conjunction with the accompanying drawings.

DESCRIPTION OF THE PREFERRED EMBODIMENTS

Figure 1:
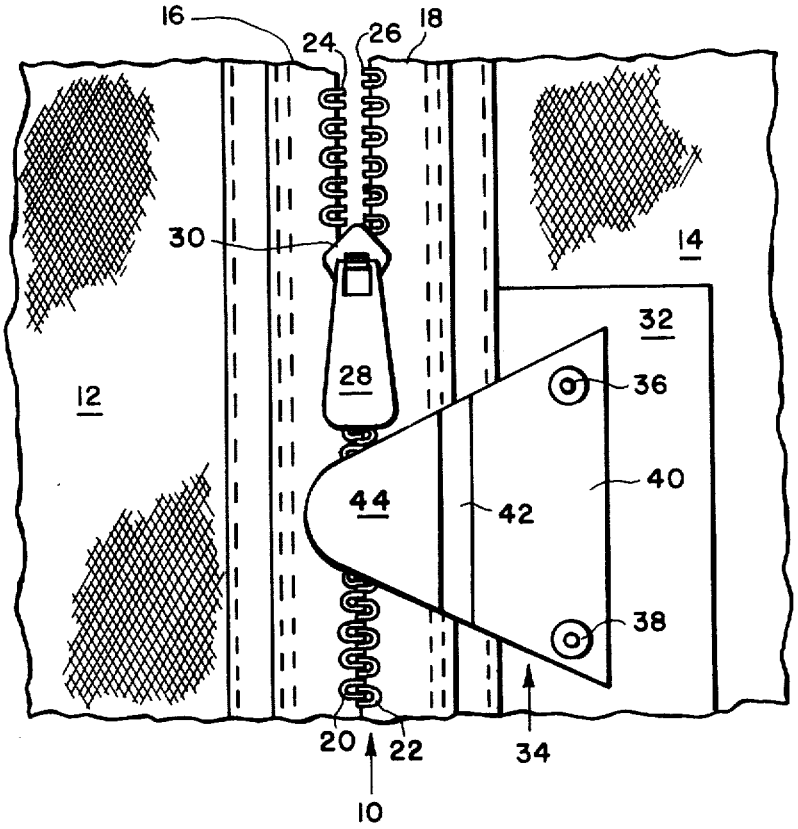
FIG. 1 is a plan view of an emergency exit slide fastener installation embodying the present invention.
Figure 2:
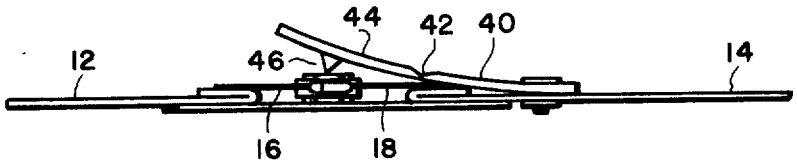
FIG. 2 is a bottom elevation view of FIG. 1.

The present invention is embodied in a slide fastener installation, indicated generally at 10 in FIG. 1, including a pair of carrier means having edges oppositely disposed to each other. In the embodiment of FIGS. 1 and 2, the pair of carrier means includes a pair of sheets 12 and 14 of material that may form an enclosure such as a tent, camper, sleeping bag, etc., and a corresponding pair of carrier tapes 16 and 18 secured to the sheets 12 and 14, respectively, adjacent the opposed edges thereof.

Continuous filamentary members 20 and 22 are respectively secured to the opposed edges of the carrier tapes 16 and 18 as by stitches (see FIGS. 1, 5 and 6), and form a plurality of interlocking elements 24 and 26, respectively. The continuous filaments 20 and 22 may be made of any suitable plastic material such as nylon, polyester, etc., and the interlocking elements 24 and 26 may be of any known filamentary configuration such as coil, meander and the like. A pull tab 28 is attached to a slider 30 that is moved longitudinally along the filaments 20 and 22 to engage and disengage the coupling elements 24 and 26 causing the slide fastener installation to be actuated between its respective closed and opened positions.

A backing or support sheet 32 made of stiffening material, such as canvas, is secured to the sheet 14 to provide support for a mounting or operating bracket, indicated generally at 34. The bracket 34 is secured to the support sheet 32 by any suitable fastener, such as rivets 36 and 38 which extend through the sheet 14 as well as the support sheet 32. The bracket 34 is made of any suitable flexible material, such as plastic, into a generally triangular configuration. A base portion of the bracket 34 defines its mounting end 40 and an intermediate portion 42 defines a flexible hinge between the mounting end 40 and an apex end 44 which serves as a presser pad portion that carries a movable member 46 on its undersurface. As is shown in FIGS. 1 and 2, the movable member 46 constitutes projection means shaped as an inverted cone with a rounded apex end disposed above the engaged interlocking elements 24 and 26.

Figure 3:
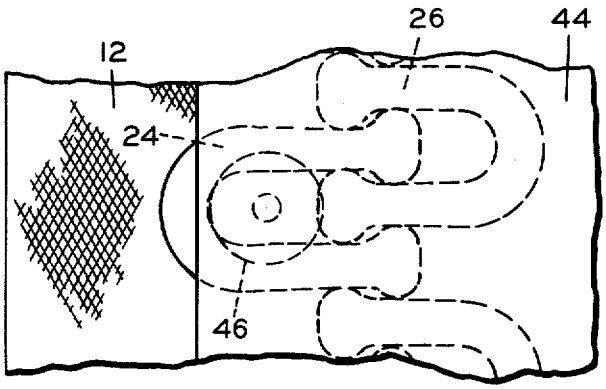
FIG. 3 is a partial bottom plan view of FIG. 2 on an enlarged scale.

To operate the emergency exit device of the present invention as embodied in FIGS. 1–3, the occupant of an enclosure or tent needs only to press against the presser pad section 44 thereby flexing the hinge 42, and forcing the movable projecting cone 46 inbetween a pair of coupling elements 24 and 26. Once a single pair of coupling elements 24 and 26 are disengaged, the opening created is easily expanded up and down the filaments 20 and 22 by only slight pressure on the bracket 34. Only slight pressure is needed to create the initial break between the filaments 20 and 22 and even less pressure is required to complete the separation.

Thus the installation of the present invention permits any easy and quick exit from any enclosure wherein the entrance is closed by a slide fastener installation. This is particularly advantageous since similar slide fastener installations are being increasingly used in a variety of applications, especially in such things as sleeping bags, campers and tents. In an emergency, any occupants of such an enclosure may need to effect a quick exit, particularly in the event of a fire. In a fire emergency there may be panic and operation of the conventional slide fastener slider may prove too slow and cumbersome. Thus the present invention is used to provide quick exit with one simple push and without requiring any pulling, unfastening or unlocking. The assembly is also extremely easy to reassemble since pulling the slider 30 down the filaments 20 and 22 to open the slide fastener and then pulling it back to reclose the coupling elements 24 and 26 will completely reassemble the entire installation.

Figure 4:
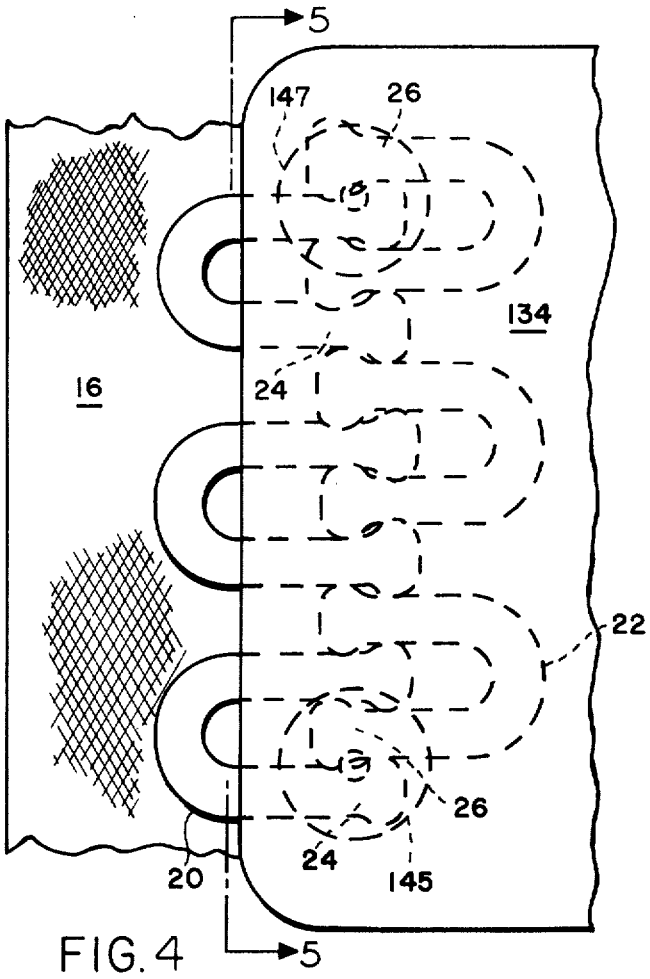
FIG. 4 is a partial bottom plan view similar to FIG. 3 but showing an embodiment of FIG. 3.
Figure 5:
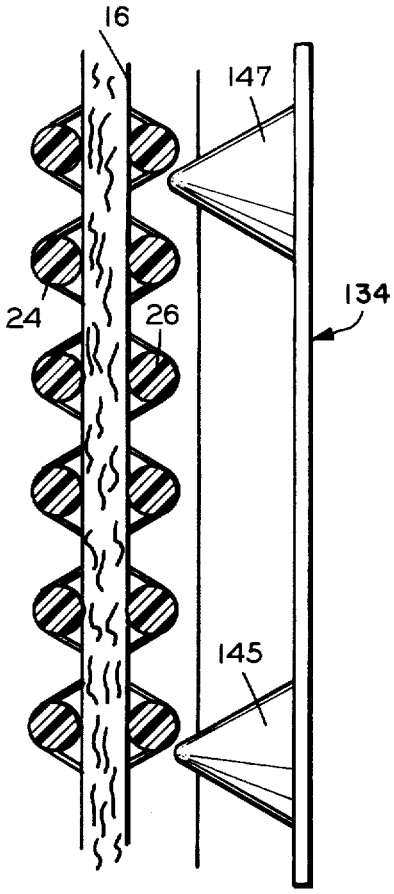
FIG. 5 is a cross section taken along line 5—5 of FIG. 4.
Figure 6:
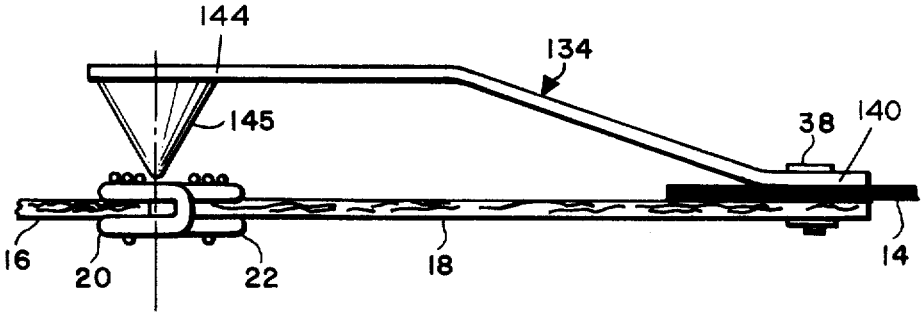
FIG. 6 is a bottom elevation view of FIG. 4 with parts added.

Another embodiment of the invention is shown in FIGS. 4–6 wherein idential parts described above are given identical reference numbers, similar parts are given similar numbers with 100 added, and new parts are given new numbers in the 100 series; accordingly, only the differences of structure and operation in this embodiment are beind described in detail.

As is shown in FIGS. 4–6, the mounting or operating bracket 134 is an elongated rectangular plate with its mounting end 140 fastened as by rivets 38 to the carrier tape 18. In this instance, the emergency opening device is attached directly to the carrier tape 18; however, to facilitate its assembly onto sheet material, the rivets 28 are attached after the adjacent edge of the sheet material 14 has been sandwiched between the tape 18 and the mounting end 140. The projecting means includes a pair of spaced inverted conical members 145 and 147 carried on the undersurface of the presser pad portion 144 so as to be disposed above the engaged interlocking elements 24 and 26.

The operation of this embodiment is similar to that of the embodiment of FIGS. 1–3, again requiring only a simple push to open the slide fastener. This embodiment takes advantage of the inherent flexibility between a mounting tape 18 and a sheet such as 14, which bend freely with respect to each other. Additional flexibility may also be obtained by forming the bracket 134 of a more flexible material, such as cloth.

It should be readily apparent that any number of inverted cones may be provided on the bracket in accordance with the present invention. In addition the bracket may be secured to either one of the sheets joined together in any known manner such as sewing, ultrasonic welding, adhesives, etc., rather than riveting and may be secured to a mounting tape alone rather than to either sheet.

As is well known in the art, the filaments 20 and 22 may be formed in a variety of configurations other than the ladder or meander type illustrated in FIGS. 1–6. As shown in FIGS. 4–6, the projecting cones 145 and 147 are located along the longitudinal center line defined by the engaged interlocking elements 24 and 26 so as to engage the adjacent edges of the heads of adjacent interlocking elements 24 and 26.

While the location of the projecting means may vary to meet the requirements of a particular slide fastener, the off center line location shown in FIG. 3 has been tested with very satisfactory results; in this instance, the cone 46 is diposed to engage the adjacent legs of the same interlocking element 24. The projecting cone 46 is forced against the two legs of the interlocking element 24 causing separation of such legs whereby the head of the opposite element 26 is released.

Inasmuch as the present invention is subject to many modifications, variations and changes in detail, it is intended that all matter contained in the foregoing description or shown in the accompanying drawings shall be interpreted as illustrative and not in a limiting sense.

What is claimed is:

1. A slide fastener installation comprising a pair of carrier means, each having an edge portion, said edge portions being oppositely disposed to each other, interlocking elements on each edge portion, the interlocking elements on one edge portion adapted to be engaged and disengaged with the interlocking elements on the other edge portion, slider means movably disposed on said pair of carrier means for engaging and disengaging said interlocking elements whereby the slide fastener installation is actuated between closed and opened positions, respectively, and emergency opening means mounted on said carrier means and including means movable in between engaged interlocking elements causing disengagement thereof whereby the slide fastener installation is rapidly actuated from its closed position to its opened position.

2. A slide fastener installation as claimed in claim 1 wherein the movable means of said emergency opening means comprises a projection having a pointed end to facilitate its movement in between the engaged interlocking elements.

3. A slide fastener installation as claimed in claim 1 wherein the interlocking elements on each edge portion are formed of a continuous filamentary plastic.

4. A slide fastener as claimed in claim 3 wherein said emergency opening means comprises a mounting bracket having one end secured to one of said carrier means and an opposite end carrying said movable means.

5. A slide fastener as claimed in claim 4 wherein said bracket has an intermediate portion and wherein said opposite end is disposed above the interlocking elements.

6. A slide fastener as claimed in claim 5 wherein the opposite end of said mounting bracket is an elongated plate end wherein said movable means comprises a plurality of spaced inverted conical projections causing said interlocking elements to be disengaged at a plurality of spaced locations along said interlocking elements.

7. A slide fastener as claimed in claim 6 wherein said pair of carrier means comprises a pair of sheets of material and said mounting bracket has its one end fixed to one of said sheets.

8. A slide fastener as claimed in claim 5 wherein the intermediate portion of said mounting bracket comprises a flexible hinge.

9. A slide fastener as claimed in claim 8 wherein said mounting bracket is a generally triangular plate and wherein said movable means comprises an inverted conical projection on the said opposite end which is defined by an apex of the triangular plate.

10. A slide fastener as claimed in claim 9 wherein said pair of carrier means comprises a pair of carrier tapes and said mounting bracket has its one end fixed to one of said carrier tapes.

11. A quick opening device for a slide fastener having two portions of material closed by engaged interlocking elements on adjacent edges of the material portions, said device comprising operating means having a first part adapted for mounting on one of said material portions and a second part adapted to extend over the interlocking elements, projecting means extending from said second part toward said engaged interlocking elements and being movable between said engaged interlocking elements by a predetermined applied force to cause separation of said engaged interlocking elements.

12. A quick opening device for a slide fastener as recited in claim 11 wherein said projecting means comprises inverted cone means disposed along a longitudinal center line defined by the engaged interlocking elements.

13. A quick opening device for a slide fastener as recited in claim 11 wherein said projecting means comprises inverted cone means disposed offset from a longitudinal center line defined by the engaged interlocking elements.

14. A quick opening device for a slide fastener as recited in claim 11 wherein said projecting means comprises a single inverted cone.

15. A quick opening device for a slide fastener as recited in claim 11 wherein said projecting means comprises a pair of spaced inverted cones.

* * * * *